US006740291B2

(12) United States Patent
Crook

(10) Patent No.: US 6,740,291 B2
(45) Date of Patent: May 25, 2004

(54) NI-CR-MO ALLOYS RESISTANT TO WET PROCESS PHOSPHORIC ACID AND CHLORIDE-INDUCED LOCALIZED ATTACK

(75) Inventor: Paul Crook, Kokomo, IN (US)

(73) Assignee: Haynes International, Inc., Kokomo, IN (US)

( * ) Notice: Subject to any disclaimer, the term of this patent is extended or adjusted under 35 U.S.C. 154(b) by 114 days.

(21) Appl. No.: 10/146,343

(22) Filed: May 15, 2002

(65) Prior Publication Data

US 2003/0215350 A1 Nov. 20, 2003

(51) Int. Cl.[7] ..... C22C 19/05

(52) U.S. Cl. ..... 420/445; 148/427; 148/428; 420/448; 420/450; 420/452; 420/453

(58) Field of Search ..... 148/427, 428; 420/445, 448, 450, 452, 453

(56) References Cited

U.S. PATENT DOCUMENTS

| | | | | |
|---|---|---|---|---|
| 3,565,611 A | | 2/1971 | Economy | |
| 4,092,183 A | * | 5/1978 | Grundy | 148/404 |
| 4,171,217 A | | 10/1979 | Asphahani et al. | |
| 4,410,489 A | | 10/1983 | Asphahani et al. | |
| 4,591,393 A | * | 5/1986 | Kane et al. | 148/707 |
| 4,778,576 A | | 10/1988 | Bon et al. | |
| 4,789,449 A | | 12/1988 | Bon et al. | |
| 4,876,065 A | | 10/1989 | Rockel et al. | |
| 4,877,461 A | * | 10/1989 | Smith et al. | 148/677 |
| 5,417,918 A | * | 5/1995 | Kohler et al. | 420/443 |
| 5,424,029 A | | 6/1995 | Kennedy et al. | |
| 5,529,642 A | | 6/1996 | Sugahara et al. | |

FOREIGN PATENT DOCUMENTS

| | | |
|---|---|---|
| EP | 0092397 | * 10/1983 |

* cited by examiner

*Primary Examiner*—John Sheehan
(74) *Attorney, Agent, or Firm*—Buchanan Ingersoll, P.C.

(57) ABSTRACT

A nickel-chromium-molybdenum alloy that is thermally stable and resistant to wet process phosphoric acid and chloride induced localized attack contains in weight percent 31.0 to 34.5% chromium, 7.0 to 10.0% molybdenum, up to 0.2% nitrogen, up to 3.0% iron, up to 1.0% manganese, up to 0.4% aluminum, up to 0.75% silicon, up to 0.1% carbon with the balance nickel plus impurities.

10 Claims, No Drawings

NI-CR-MO ALLOYS RESISTANT TO WET PROCESS PHOSPHORIC ACID AND CHLORIDE-INDUCED LOCALIZED ATTACK

FIELD OF THE INVENTION

This invention relates generally to non-ferrous metal alloy compositions, and more specifically to wroughtable, nickel alloys which contain significant quantities of chromium and molybdenum, along with the requisite minor elements, to allow successful melting and wrought processing, and which possess high resistance to wet process phosphoric acid and high resistance to chloride-induced localized attack (pitting and crevice corrosion), which is enhanced by deliberate additions of nitrogen.

BACKGROUND OF THE INVENTION

An important step in the manufacture of fertilizers is the production and concentration of phosphoric acid. This acid is typically made by reacting phosphate rock with sulfuric acid to produce what is often called "wet process" phosphoric acid. The resulting "wet process" phosphoric acid contains traces of sulfuric acid, along with other impurities from the phosphate rock, such as chlorides, which serve to increase its corrosivity.

To concentrate this "wet process" phosphoric acid, several evaporation stages are employed. The evaporator tubes are usually constructed from austenitic stainless steels or nickel-iron alloys, with chromium contents in the approximate range 28 to 30 wt. %, such as G-30 alloy (U.S. Pat. No. 4,410,489), Alloy 31 (U.S. Pat. No. 4,876,065), and Alloy 28. Copper is an essential ingredient in these alloys. These commercial materials possess inadequate resistance to either "wet process" phosphoric acid, or chloride-induced localized attack, for use in all evaporation stages, thus necessitating the use of non-metallic materials, with consequent sacrifices in robustness.

Knowing that chromium is beneficial to the "wet process" phosphoric acid resistance of austenitic stainless steels and nickel-iron alloys, materials with higher chromium contents have been contemplated. However, thermal stability has been a constraining factor. Simply stated, it is desirable to maintain the face-centered cubic atomic structure in such materials, and excessive alloying results in the formation of deleterious second phases, which impair ductility and corrosion resistance, during wrought processing or welding. Thus, higher chromium levels have hitherto not been feasible in wrought alloys designed for service in "wet process" phosphoric acid, given the need to include alloying elements other than chromium, to enhance localized corrosion resistance.

With regard to thermal stability, it is well known that elements such as chromium and molybdenum, which strongly influence resistance to "wet process" phosphoric acid and chloride-induced localized attack, are more soluble in nickel than in austenitic stainless steels. It follows that higher levels of alloying are possible in nickel alloys, if iron contents are low. It is not surprising, therefore, that some low-iron nickel alloys exist, with chromium contents in excess of 30 wt. %, and with significant molybdenum additions.

U.S. Pat. No. 5,424,029 discloses such a series of alloys, although these alloys require the addition of tungsten, in the range 1 to 4 wt. %. U.S. Pat. No. 5,424,029 states that such alloys possess superior corrosion resistance to a variety of media, although their resistance to "wet process" phosphoric acid is not addressed. Notably, it states that the absence of tungsten results in a significantly higher corrosion rate. This patent does not address nitrogen as an addition.

Another reference which discloses corrosion-resistant nickel alloys with chromium contents in excess of 30 wt. % is U.S. Pat. No. 5,529,642, although the preferred chromium range is 17 to 22 wt. %, and all compositions require the addition of tantalum, in the range 1.1 to 8 wt. %. U.S. Pat. No. 5,529,642 requires a nitrogen addition of between 0.0001 and 0.1 wt. %.

Although all of these prior art alloys are useful corrosion resistant alloys, the levels of copper, tungsten or tantalum reduce thermal stability, and therefore complicate wrought processing and welding. Yet, the prior art deems these elements necessary for optimum corrosion resistance. In fact, copper is regarded as an essential ingredient of G-30 alloy, Alloy 31, and Alloy 28.

Two further U.S. Pat. Nos., 4,778,576 and 4,789,449, disclose nickel alloys with wide-ranging chromium (5 to 30 wt. %) and molybdenum (3 to 25 wt. %) contents, for use as anodes in electrochemical cells. Both patents preferably claim anodes made from C-276 alloy, which contains 16 wt. % chromium and 16 wt. % molybdenum. Nitrogen content is not addressed in these patents. The patents report that electrodes made from this alloy are resistant to corrosion in aqueous alkaline media containing chloride ions and in concentrated hydrochloric acid solutions. But, data reported in U.S. Pat. No. 4,410,489 shows that the alloy does not resist corrosion well in phosphoric acid.

SUMMARY OF THE INVENTION

The principal object of this invention is to provide new alloys with higher combined resistance to "wet process" phosphoric acid and chloride-induced localized attack than previous alloys, without the need for deliberate additions of tungsten, tantalum, or copper which reduce thermal stability.

It has been found that the above object may be achieved by adding chromium, molybdenum, and requisite minor elements to nickel, within certain preferred ranges. Nitrogen is also a preferred addition, though it is expected that this element will be absorbed into the alloy during air melting. Specifically, the preferred ranges in weight percent are 31.0 to 34.5% chromium, 7.0 to 10.0% molybdenum, up to 0.2% nitrogen, up to 3.0% iron, up to 1.0% manganese, up to 0.4% aluminum, up to 0.75% silicon and up to 0.1% carbon. The most preferred ranges are 32.5 to 34.0% chromium, 7.5 to 8.6% molybdenum, up to 0.15% nitrogen, up to 1.5% iron, 0.1 to 0.4% manganese, 0.2 to 0.4% aluminum, up to 0.5% silicon and up to 0.02% carbon.

It has also been found that these alloys can tolerate impurities that might be encountered from the melting of other corrosion-resistant nickel alloys, especially copper (up to 0.3 wt. %) and tungsten (up to 0.65 wt. %). Up to 5 wt. % cobalt can be used in place of nickel. It is anticipated that small quantities of other impurities, such as niobium, vanadium, and titanium would have little or no effect on the general characteristics of these materials.

DETAILED DESCRIPTION OF THE INVENTION

The discovery of the compositional range defined above involved several stages. First, several experimental, copper-bearing alloys of varying chromium, molybdenum, and copper contents were melted and tested. The results indicated that chromium is the most beneficial element as regards resistance to "wet process" phosphoric acid, and that chromium levels in excess of 30 wt. % are necessary to improve upon the performance of current materials in this environment.

In the second stage, copper-free alloys were melted and tested. Surprisingly, the test results indicated that, at a chromium content of approximately 33 wt. %, copper is not essential to high resistance to "wet process" phosphoric acid. Moreover, without the addition of copper, and with iron at only about 1 wt. %, it was found possible to add molybdenum at approximately 8 wt. % while maintaining good thermal stability. This resulted in high resistance to chloride-induced localized attack. In the third stage, experiments were carried out to establish the upper and lower limits of this alloy system, and to study the effects of nitrogen and anticipated impurities. It is believed that nitrogen will be present if the alloy is melted in air, due to its natural solubility. Contamination from impurities is common in furnaces used to melt a variety of alloys.

The compositional analyses, in wt. %, of the experimental alloys relevant to this invention are given in Table 1, in order of increasing chromium contents. Chromium, molybdenum, and nitrogen are regarded as the primary alloying elements. Iron, manganese, aluminum, silicon, and carbon are regarded as the requisite elements, important to the melting and remelting operations, but not essential. Copper and tungsten are regarded as impurities.

EN2201 represents the base composition of the present invention, EN5301 was melted to investigate the low end of the chromium range, EN2101 was melted to investigate the low end of the molybdenum range, and EN7101 was melted to investigate the high end of the range. EN5601 was melted to study the effects of nitrogen in the base composition. EN5501 was melted to study the effects of higher iron, and the presence of the potential impurities, copper and tungsten, in the base composition. EN5401 was melted to study the effects of higher chromium and molybdenum levels, without the complication of higher requisite element and impurity levels. No copper or tungsten was added to EN5301, EN2201, EN5601, EN2101 or EN5401, so the levels detected are impurity contents.

TABLE 1

| | Ni | Cr | Mo | Fe | Mn | Al | Si | C | N | Cu | W |
|---|---|---|---|---|---|---|---|---|---|---|---|
| EN5301* | BAL | 31.7 | 7.6 | 1.1 | 0.2 | 0.24 | 0.27 | 0.04 | <0.01 | 0.02 | 0.04 |
| EN2201* | BAL | 32.7 | 8.1 | 1 | 0.29 | 0.24 | 0.34 | 0.04 | <0.01 | <0.01 | N/A |
| EN5601* | BAL | 32.8 | 8.1 | 1 | 0.24 | 0.21 | 0.29 | 0.04 | 0.18 | 0.02 | 0.04 |
| EN2101 | BAL | 32.9 | 5.1 | 1 | 0.28 | 0.26 | 0.33 | 0.04 | N/A | <0.01 | N/A |
| EN5501* | BAL | 32.9 | 8.1 | 2 | 0.22 | 0.23 | 0.3 | 0.04 | <0.01 | 0.34 | 0.65 |
| EN5401* | BAL | 33.9 | 8.5 | 1.1 | 0.25 | 0.24 | 0.26 | 0.04 | <0.01 | 0.02 | 0.04 |
| EN7101 | BAL | 34.7 | 10.2 | 3 | 1.1 | 0.43 | 0.81 | 0.14 | 0.22 | 1.2 | 1.17 |

N/A = Not Analyzed
*Alloys of the present invention

For comparison, G-30 alloy, Alloy 31, Alloy 28 and C-276 alloy were also tested. The preferred alloys of U.S. Pat. Nos. 5,424,029 (Alloy A) and 5,529,642 (Alloy 13), and the closest alloy of U.S. Pat. No. 5,529,642 (Alloy 37) were also melted and tested where possible. The compositions of these prior art alloys are given in Table 2.

TABLE 2

| | Ni | Cr | Mo | Fe | Mn | Al | Si | C | N | Cu | OTHER |
|---|---|---|---|---|---|---|---|---|---|---|---|
| G-30 | BAL | 29.9 | 4.9 | 14 | 1.1 | 0.16 | 0.32 | 0.01 | — | 1.5 | Co: 0.6<br>W: 2.7<br>Nb: 0.8 |
| 31 | 32 | 27 | 6.5 | BAL | 1.5 | — | 0.09 | <0.01 | 0.19 | 1.3 | — |
| 28 | 30.7 | 26.8 | 3.5 | BAL | 1.5 | — | 0.3 | 0.01 | — | 1.2 | — |
| C-276 | BAL | 15.6 | 15.4 | 6 | 0.5 | 0.23 | 0.04 | <0.01 | 0.02 | 0.07 | Co: 1.5<br>W: 4<br>V: 0.15 |
| A | BAL | 31 | 10.1 | 0.1 | <0.01 | 0.25 | 0.02 | 0.03 | <0.01 | 0.01 | W: 2.3<br>Nb: 0.44<br>Ti: 0.28 |
| 13 | BAL | 20.5 | 22.1 | 0.07 | 0.52 | 0.02 | 0.11 | 0.02 | <0.01 | <0.01 | Ta: 1.9 |
| 37 | BAL | 34.8 | 8.3 | 0.1 | 0.73 | 0.02 | 0.21 | 0.03 | <0.01 | <0.01 | Ta: 4.9<br>W: 3.9 |

The experimental alloys, and the prior art alloys of U.S. Pat. Nos. 5,424,029 and 5,529,642, were vacuum induction melted, then electro-slag remelted, at a heat size of 50 lb. The ingots so produced were soaked, then forged and rolled, at 1204° C. Alloys 13 and 37 of U.S. Pat. No. 5,529,642 cracked so badly during forging and rolling that they had to be scrapped at thicknesses of 2 in and 1.2 in, respectively. Also, EN7101 cracked so badly during forging that it had to be scrapped at a thickness of 2 in. Those alloys which were successfully rolled to the required test thickness of 0.125 in were subjected to annealing trials, to determine the most suitable annealing treatment. In all cases, this was 15 min at 1149° C., followed by water quenching. G-30 alloy, Alloy 31, Alloy 28, and C-276 alloy were all tested in the condition sold by the manufacturer, the so-called "mill annealed" condition.

Prior to testing of the experimental and prior art alloys, it was established that 54 wt. % was a particularly corrosive concentration of "wet process" phosphoric acid ($P_2O_5$), at 135° C. Therefore, all the alloys successfully rolled to sheets of thickness 0.125 in were tested in this environment, along with similar sheets of the commercial alloys. The tests were carried out in autoclaves for a duration of 96 hr, without interruption. With regard to chloride-induced localized attack, the test defined in ASTM Standard G 48-00 Method C was used. This involves testing in 6 wt. % ferric chloride ($FeCl_3$) and 1 wt. % hydrochloric acid (HCl) at different temperatures, to determine the critical pitting temperature, the lowest at which pitting occurs over a duration of 72 hr. The surfaces of all samples were manually ground prior to test, to negate any mill finish effects.

The results of testing are given in Table 3, along with a measure of thermal stability, namely the electron vacancy number, $N_v$. In essence, alloys of the present invention provide high resistance to "wet process" phosphoric acid, i.e. a corrosion rate of 0.35 mm/y or less in 54 wt. % $P_2O_5$ at 135° C., high resistance to chloride-induced localized attack, i.e. a critical pitting temperature greater than 65° C. when tested to ASTM Standard G 48-00 Method C, and thermal stability sufficient to allow easy wrought processing, i.e. an $N_v$ value equal to or less than 2.7. All prior art alloys except Alloy A had a higher corrosion rate in wet process phosphoric acid. But alloy A contains 2.3% tungsten which makes the alloy more difficult to work as reflected by the 2.76 $N_v$ number. Furthermore, U.S. Pat. No. 5,424,029 says in this type of alloy tungsten levels must be 1 to 4 percent to achieve satisfactory corrosion resistance. Yet, surprisingly the alloys of the present invention achieve good corrosion results without tungsten. Furthermore, alloy EN5501 demonstrates that up to 0.65 tungsten can be tolerated without adversely affecting workability. The corrosion rate for the alloys of the present invention is also significantly lower than the 0.44 mm/y rate for C-276 reported in U.S. Pat. No. 4,410,489, Table 3 in 46% $P_2O_5$ at 116° C.

TABLE 3

| | CORROSION RATE IN 54% $P_2O_5$ AT 135° (mm/y) | CRITICAL PITTING TEMPERATURE IN 6% $FeCl_3$ + 1% HCl (° C.) | Nv |
|---|---|---|---|
| EN5301* | 0.35 | 75 | 2.55 |
| EN2201* | 0.29 | 75 | 2.63 |
| EN5601* | 0.28 | >95 | 2.63 |
| EN2101 | 0.28 | 45 | 2.45 |
| EN5501* | 0.33 | 85 | 2.7 |
| EN5401* | 0.3 | 85 | 2.7 |
| EN7101 | UNABLE TO PROCESS | | 3.13 |
| G-30 | 0.43 | 60 | 2.85 |
| 31 | 0.53 | 75 | 2.98 |
| 28 | 0.64 | 45 | 2.88 |
| C-276 | 1.53 | >95 | 2.63 |
| A (PATENT 5,424,029) | 0.34 | >95 | 2.76 |
| 13 (PATENT 5,529,642) | UNABLE TO PROCESS | | 3.01 |
| 37 (PATENT 5,529,642) | UNABLE TO PROCESS | | 3.02 |

*Alloys of the present invention

Several observations may be made concerning the general effects of the alloying elements, as follows:

Chromium (Cr) is a primary alloying element. It provides high resistance to "wet process" phosphoric acid. The preferred chromium range is 31.0 to 34.5 wt. %. Below 31.0 wt. %, the alloys have insufficient resistance to "wet process" phosphoric acid: above 34.5 wt. %, the thermal stability of the alloys is jeopardized. The most preferred chromium range is 32.5 to 34.0 wt. %.

Molybdenum (Mo) is also a primary alloying element. It provides high resistance to chloride-induced localized attack, such as crevice corrosion and pitting. The preferred molybdenum range is 7.0 to 10.0 wt. %. Below 7.0 wt. %, the alloys have insufficient resistance to chloride-induced localized attack; above 10.0 wt. %, thermal stability problems arise. The most preferred molybdenum range is 7.5 to 8.6 wt. %.

Although not essential, nitrogen (N) is a primary alloying element, which strongly enhances resistance to chloride-induced localized attack. In air melted heats, it is anticipated that at least 0.03 wt. % will be absorbed. Additional quantities may be added within the preferred range, up to 0.2 wt. %, or the more preferred range, up to 0.15 wt. %. An acceptable, nitrogen-free alloy might be possible using vacuum melting, as it was in the work leading up to this invention. Beyond 0.2 wt. %, nitrogen will contribute to forging difficulties.

Iron (Fe) is a requisite element, preferred at levels up to 3.0 wt. %, and more preferably up to 2.0 wt. %. It allows economic use of revert materials, most of which contain residual amounts of iron. An acceptable, iron-free alloy might be possible, using new furnace linings and high purity charge materials. At levels above 3.0 wt. %, iron causes thermal instability.

Manganese (Mn) is also a requisite element, used for the control of sulfur. It is preferred at levels up to 1.0 wt. %, and more preferably, with electric arc melting followed by argon-oxygen decarburization, in the range 0.1 to 0.4 wt. %. Above a level of 1.0 wt. %, manganese contributes to thermal instability. Acceptable alloys with very low manganese levels might be possible with vacuum melting.

Aluminum (Al) is a requisite element, used for the control of oxygen, molten bath temperature, and chromium content, during argon-oxygen decarburization. The preferred range is up to 0.4 wt. %, and the more preferred, with electric arc melting followed by argon-oxygen decarburization, is 0.2 to 0.4 wt. %. Above 0.4 wt. %, aluminum contributes to thermal stability problems. Acceptable alloys with very low aluminum levels might be possible with vacuum melting.

Silicon (Si) is also a requisite element used for the control of oxygen and chromium content. The preferred range is up to 0.75 wt. %, and the more preferred range is up to 0.5 wt. %. Forging problems, due to thermal instability, are expected at silicon levels in excess of 0.75 wt. %. Acceptable alloys with very low silicon contents might be possible with vacuum melting.

Carbon (C) is requisite to the electric arc melting process, although it is reduced as much as possible during argon-oxygen decarburization. The preferred carbon range is up to 0.1 wt. %, beyond which it contributes to thermal instability, through the promotion of carbides in the microstructure. The more preferred range is up to 0.02 wt. %. Acceptable alloys with very low carbon contents might be possible with vacuum melting, and high purity charge materials.

It has been shown that common impurities can be tolerated. In particular, it has been shown that copper can be tolerated up to 0.3 wt. %, and tungsten can be tolerated up to 0.65 wt. %. On the other hand, elements such as niobium, titanium, vanadium, and tantalum, which promote the formation of nitrides and other second phases, should be held at low levels, for example, less than 0.2 wt. %. Other impurities that might be present at low levels include sulfur (up to 0.015 wt. %), phosphorus (up to 0.03 wt. %), oxygen (up to 0.05 wt. %), magnesium (up to 0.05 wt. %), and calcium (up to 0.05 wt. %). The last two of these are involved with deoxidization. It is likely that small quantities of cobalt could be deliberately added to the alloys of this invention, in place of nickel, without altering their properties significantly, since cobalt has only a small influence on the thermal stability of nickel alloys, and is not known to degrade corrosion resistance. Cobalt may therefore be present up to 5 wt. %.

Even though the samples tested were all wrought sheets, the alloys should exhibit comparable properties in other wrought forms (such as plates, bars, tubes and wires) and in cast and powder metallurgy forms. Consequently, the present invention encompasses all forms of the alloy composition.

Although I have disclosed certain present preferred embodiments of the alloy, it should be distinctly understood that the present invention is not limited thereto but may be variously embodied within the scope of the following claims.

What is claimed is:

1. A nickel-chromium-molybdenum alloy resistant to wet process phosphoric acid and chloride-induced localized attack, consisting essentially of:

| | |
|---|---|
| 31.7 to 34.5 wt. % | Chromium |
| 7.0 to 9.0 wt. % | Molybdenum |
| Up to 0.2 wt. % | Nitrogen |
| Up to 3.0 wt. % | Iron |
| Up to 1.0 wt. % | Manganese |
| Up to 0.4 wt. % | Aluminum |
| Up to 0.75 wt. % | Silicon |
| Up to 0.1 wt. % | Carbon |

with a balance of nickel and impurities.

2. A nickel-chromium-molybdenum alloy resistant to wet process phosphoric acid and chloride-induced localized attack, consisting essentially of:

| | |
|---|---|
| 32.5 to 34.0 wt. % | Chromium |
| 7.5 to 8.6 wt. % | Molybdenum |
| Up to 0.15 wt. % | Nitrogen |
| Up to 1.5 wt. % | Iron |
| 0.1 to 0.4 wt. % | Manganese |
| 0.2 to 0.4 wt. % | Aluminum |
| Up to 0.5 wt. % | Silicon |
| Up to 0.02 wt. % | Carbon |

with a balance of nickel and impurities.

3. The nickel-chromium-molybdenum alloy of claim 1, wherein the impurities comprise copper, up to 0.3 wt. %, and tungsten, up to 0.65 wt %.

4. The nickel-chromium-molybdenum alloy of claim 1, wherein the impurities comprise levels of at least one of niobium, titanium, vanadium, tantalum, sulfur, phosphorus, oxygen, magnesium, and calcium.

5. The nickel-chromium-molybdenum alloy of claim 1, wherein cobalt is used in place of nickel, up to 5 wt. %.

6. The nickel-chromium-molybdenum alloy of claim 1 wherein the alloy is in wrought forms selected from the group consisting of sheets, plates, bars, wires, tubes, pipes and forgings.

7. The nickel-chromium-molybdenum alloy of claim 1 wherein the alloy is in cast form.

8. The nickel-chromium-molybdenum alloy of claim 1 wherein the alloy is in powder metallurgy form.

9. A nickel-chromium-molybdenum alloy resistant to wet process phosphoric acid and chloride-induced localized attack, consisting essentially of:

| | |
|---|---|
| 31.7 to 33.9 wt. % | Chromium |
| 8.1 to 8.5 wt. % | Molybdenum |
| Up to 0.18 wt. % | Nitrogen |
| 1.0 to 1.1 wt. % | Iron |
| 0.24 to 0.29 wt. % | Manganese |
| 0.21 to 0.24 wt. % | Aluminum |
| 0.26 to 0.34 wt. % | Silicon |
| Up to 0.04 wt. % | Carbon |
| Up to 0.02 wt. % | Copper |
| Up to 0.04 wt. % | Tungsten |

with a balance nickel plus impurities.

10. A nickel-chromium-molybdenum alloy resistant to wet process phosphoric acid and chloride-induced localized attack, consisting essentially of:

| | |
|---|---|
| 31.7 to 32.8 wt. % | Chromium |
| 8.1 wt. % | Molybdenum |
| Up to 0.18 wt. % | Nitrogen |
| 1.0 wt. % | Iron |
| 0.24 to 0.29 wt. % | Manganese |
| 0.21 to 0.24 wt. % | Aluminum |

-continued

| | |
|---|---|
| 0.29 to 0.34 wt. % | Silicon |
| Up to 0.04 wt. % | Carbon |
| Up to 0.02 wt. % | Copper |
| Up to 0.04 wt. % | Tungsten |

with a balance nickel plus impurities.

* * * * *